United States Patent [19]

Sato et al.

[11] 4,429,538

[45] Feb. 7, 1984

[54] GAS TURBINE COMBUSTOR

[75] Inventors: Isao Sato; Yohji Ishibashi; Yoshimitsu Minakawa; Takashi Ohmori; Zensuke Tamura; Yoshihiro Uchiyama; Ryoichiro Ohshima, all of Hitachi, Japan

[73] Assignee: Hitachi, Ltd., Tokyo, Japan

[21] Appl. No.: 234,015

[22] Filed: Feb. 12, 1981

[30] Foreign Application Priority Data

Mar. 5, 1980 [JP] Japan ..... 55-26630

[51] Int. Cl.[3] ..... F02C 3/14

[52] U.S. Cl. ..... 60/748; 60/755

[58] Field of Search ..... 60/748, 755, 728, 732, 60/756, 757

[56] References Cited

U.S. PATENT DOCUMENTS

| | | | |
|---|---|---|---|
| 2,622,395 | 12/1952 | Bowden | 60/728 |
| 3,608,309 | 7/1971 | Hill et al. | 60/748 |
| 3,630,024 | 12/1971 | Hopkins | 60/748 |
| 3,980,233 | 9/1976 | Simmons et al. | 60/748 |
| 4,006,589 | 2/1977 | Schirmer | 60/748 |
| 4,007,001 | 2/1977 | Schirmer et al. | 60/748 |
| 4,081,958 | 4/1978 | Schelp | 60/728 |
| 4,222,243 | 9/1980 | Mobsby | 60/748 |
| 4,271,675 | 6/1981 | Jones et al. | 60/748 |

FOREIGN PATENT DOCUMENTS

| | | | |
|---|---|---|---|
| 52-52015 | 4/1977 | Japan | 60/748 |
| 53-27715 | 3/1978 | Japan | 60/748 |
| 54-112410 | 9/1979 | Japan . | |
| 582479 | 9/1958 | Italy | 60/755 |
| 671937 | 5/1952 | United Kingdom | 60/748 |

*Primary Examiner*—Louis J. Casaregola

*Attorney, Agent, or Firm*—Antonelli, Terry & Wands

[57] ABSTRACT

A gas turbine combustor comprising a combustor inner-pipe for forming a head combustion chamber and a rear combustion chamber having a diameter larger than a diameter of head combustion chamber. A combustor outer-pipe covers the combustor inner-pipe, and a fuel nozzle is disposed at an end part of the head combustion chamber for supplying fuel to said combustor inner pipe. A first group of ports are arranged for swirling and feeding air in an axial direction of the combustor inner-pipe. The first group of ports are around the fuel nozzle. A second group of ports for swirling and feeding air in a radial direction of said combustor inner-pipe are disposed in a side wall of the head combustion chamber near the fuel nozzle. A third group of ports for swirling and feeding air in a radial direction of the combustion inner-pipe and a fourth group of ports for feeding air in a radial direction of the combustor inner-pipe are provided and ar both disposed in a side wall of the head combustion chamber near the said rear combustion chamber. A fifth group of ports are disposed in a side wall of the rear combustion chamber near the head combustion chamber and a sixth group of ports are disposed in a side wall of the rear combustion chamber on a downstream side of the fifth group of ports. Another group of ports for swirling and feeding air into the head combustion chamber are disposed in a vicinity of a central portion of an end part of the head combustion chamber along an inner periphery of the fuel nozzle, with this group of ports and the first group of ports being constructed so that air flowing from both groups of ports has the same swirling direction.

21 Claims, 10 Drawing Figures

FIG. 1
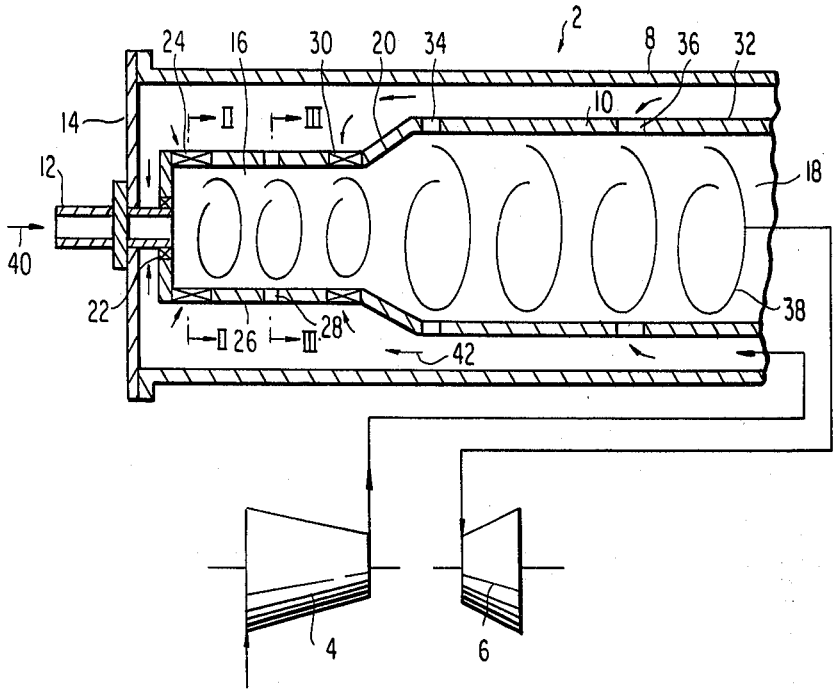
FIG. 2
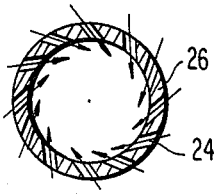
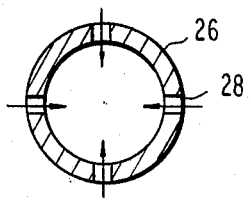
FIG. 3
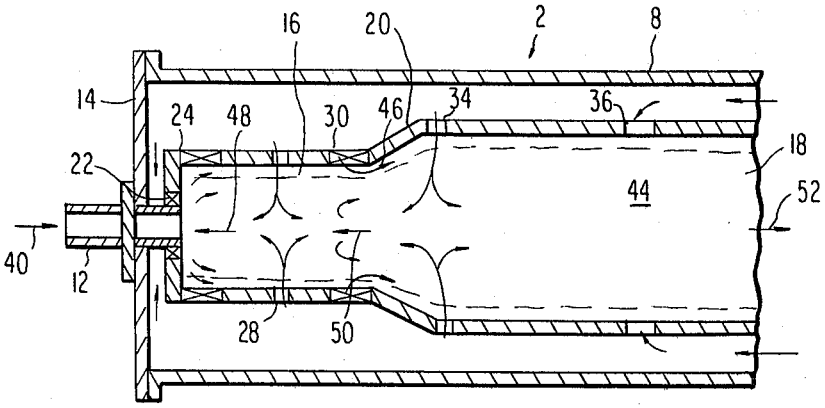
FIG. 4

GAS TURBINE COMBUSTOR

The present invention relates to a combustor arrangement and, more particularly to an arrangement for reducing nitrogen oxides and carbon monoxides in exhaust gases of a combustor of a gas turbine.

Exhaust gases from a gas turbine contain air pollutants in the form of nitrogen oxides (NOx) and carbon monoxide (CO). The suppression of emission of these pollutants is equally if not more important than enhancing the performance and the reliability of the gas turbine. Especially recently, the requirements for emission control of NOx has become severe, and it has been advocated to further reduce the present emission quantity of NOx and CO to 1/10th or less of the present contents.

In a gas turbine, the source of the NOx and CO pollutants is the combustor and, to eliminate the pollutants, it has been proposed to suppress the production of the pollutants within the combustor or to mount a so-called post-processor, such as denitrifier, for removing NOx and CO in the exhaust gas, While the installation of the post-processor results in increasing the operating costs of the gas turbine and somewhat adversely affects the performance of the provision of a post-processor is nevertheless the best expedient for reducing NOx and CO in the exhaust gases from the combustor.

The rate of production of NOx can be determined by the following equation:

$$d(\mathrm{NOx})/dt = K \exp(E/T)\,[N]\,[O]^{\frac{1}{2}}$$

wherein:

t=time;

k=proportional constant;

E=activation energy;

T=temperature; and

[N] and [O]=partial pressure of N and O.

Since the production of NOx is particularly greatly dependent upon temperature increases, as the temperature increases, so does the production of NOx. Moreover, the production of NOx increases as the partial pressure increases.

A gas turbine combustor with a combustor control arrangement for lowering the NOx in the exhaust gases has been proposed, wherein the combustor includes a combustor outer-pipe, a combustor inner-pipe, which is constructed as a head combustion chamber and a rear combustion chamber larger in diameter than the head combustion chamber, and a fuel nozzle arranged at an end part of the combustor inner-pipe on a side of the head combustion chamber. Two different combustion systems have been proposed for this type combustor with an aim to lowering the NOx in the exhaust gases.

A first combustion system proposes enriching the fuel in the head combustion chamber and thinning the fuel in the rear combustion chamber. In this proposed combustion system, it becomes possible to some extent to lower NOx by eliminating high-NOx combustion at a stoichiometric mixture; however, with a combustion process in the combustor at a high air ratio, a region which establishes the the stoichiometric mixture appears inevitably in the course of the combustion process hinders the effective reduction of NOx. Moreover, in a gas turbine combustor in which the staying time of a gas is short, there is an increase in the quantity of carbon produced in the head combustion chamber. A disadvantage of the increased carbon production resides in the fact that the carbon does not burn up and the combustion emits black smoke or soot.

In a second proposed combustion system such as proposed in, for example, Japanese Laid-Open Patent Publication 54-112410(1979), the second combustion chamber is supplied with excess air. For this purpose, a first group of air swirling and feeding ports for swirling and supplying air in an axial direction are disposed around the fuel nozzle, with a second group of air swirling and feeding ports, whose respective ports are open in substantially a tangential direction of an inner peripheral surface of the combustion chamber for swirling and supplying air in a radial direction, are disposed in a side wall of the head combustion chamber on a side of the fuel nozzle. Additionally, a group of air feeding ports for cooling a temperature of the combustion gas down to a turbine inlet temperature are disposed in the rear combustion chamber.

NOx are mainly produced within the head combustion chamber, and the so-called excess air, i.e. quantity of air greater than the required minimum quantity of air (amount of theoretical air) for a complete combustion of the fuel, is supplied into the head combustion chamber so as to perform low-temperature combustion and to achieve the reduction of NOx. The quantity of air to be supplied into the head combustion chamber is approximately 50% of the total quantity of air including the quantity of air to be supplied into the rear combustion chamber, and the air quantity corresponds to approximately 1.7 times the amount of theoretical air for the fuel at the related load of the gas turbine. Thus, a low-NOx combustor provided with the head combustion chamber can attain a NOx reduction of approximately 70% as compared with a combustor which has the same diameter and which is not provided with the head combustion chamber.

Furthermore, even when excess air is supplied the combustion flames are stabilized by the swirling air flow. However, when the swirl intensity, also termed swirl number, is increased in order to attain the stabilization of the flames, a stagnant region of low-temperature air is formed along the wall surface of the rear combustion chamber in and behind an enlarged portion extending from the head combustion chamber to the rear combustion chamber, so that CO is produced in large quantities in and behind the enlarged portion due to supercooling.

To avoid the production of large quantities of CO, a combustor has been proposed, wherein a group of air feeding ports are circumferentially disposed on a lower stream side of a side wall of the head combustion chamber and in an enlarged portion from the head combustion chamber to the rear combustion chamber. The intense air flow from the group of air feeding ports disposed at the enlarged portion gives rise to a pull-in or suction flow which draws in the ambient air. Thus, the production of CO in the above noted region is eliminated to some extent.

However, with this last mentioned combustor, the air flow forms a flame recess in the swirling air flow from the head combustion chamber somewhat downstream of the enlarged portion, and although the production of CO on the wall surface of the rear combustion chamber can be suppressed, a new low-temperature region is formed on substantially an extension of the inside diameter of the head combustion chamber, which new low-temperature region generates a large quantity of CO.

Additionally, a low temperature region is formed in a vicinity of the inner wall surface of the head combustion chamber due to the fact that the excess air is drawn because of the power or strength of the swirling air flow along the vicinity of the inner wall surface. The above-noted phenomena become even more evident when a gaseous fuel rather than a liquid fuel is used.

With the case of liquid fuel, during the course of the combustion process, fuel particles atomized by the nozzle gradually vaporize and a gas which develops as a result of the vaporization of the fuel particles burns during the combustion process. When the fuel particles are microscopically observed, the liquid drops mix with air while vaporizing and then burn. Herein, the flame front of each particle always sustains the optimum combustion condition, i.e., the combustion at the amount of theoretical combustion air without being effected by the excess air. Accordingly, the temperature of the combustion flames becomes high. Moreover, even when the large quantity of excess air is supplied, the combustion flames are difficult to extinguish and there is little fluctuation in the length of the combustion flames. The extinguishing of and the fluctuation of the length of the combustion flames may be called the "flame instability phenomenon". With liquid fuel, an increase in the feed quantity of air lengthens the combustion flames, and moreover, the temperature of lengthened combustion flames suppresses the appearance of the low-temperature regions.

On the other hand, with a gaseous fuel, the fuel component diffuses into the excess air immediately after its inflow from the fuel nozzle because the gaseous fuel does not involve the vaporization process and the mixing between the air and the fuel is carried out very smoothly. Accordingly, when the air in an amount equal to that of the liquid fuel is applied, the entire combustion gas is undercooled, and the quantity of production of CO increases remarkably. Even when the quantity of excess air is decreased, the temperature of the flames becomes lower than that when the liquid fuel is used. Moreover, the flame instability phenomenon becomes greater than that when the liquid fuel is used. The flames become so short as to burn violently on the upper stream side of the head combustion chamber, that is, on the side of the fuel nozzle. Thus, with gaseous fuel, the generation of the low-temperature region is promoted.

Recently, because of a change in the availability of petroleum based fuels, instead of using a liquid fuel such as petroleum, the use of a gaseous fuel such as, for example, natural gas and coal gas has been reconsidered. Furthermore, since in the combustion process of the gaseous fuel, the gaseous fuel smoothly mixes with air, there is difficulty in the formation of hot spots such as could occur with high temperature so that only small amounts of NOx are produced. In general, the gaseous fuel is lower in the $N_2$ content and, therefore, smaller in the amount of production of the so-called fuel NOx than the liquid fuel. For these reasons, a low-NOx gas turbine combustor which does not undergo the "flame instability phenomenon" even with a gaseous fuel, and which has the function of suppressing the reduction of CO is earnestly desired.

NOx are principally produced in the combustion process within the head combustion chamber, and especially the uniform mixing between the fuel and the air streams through the air feeding ports is greatly influential on the reduction of NOx.

In the proposed combustors, high NOx concentration parts exist in a vicinity of an axial part within a head combustion chamber and in an enlarged portion between the head combustion chamber and the rear combustion chamber. Particularly, NOx concentration in the axial part near to the fuel nozzle within the head combustion chamber is high, and this axial part greatly governs the generation of NOx. The air streams from the air feeding ports mix with the fuel injected from the fuel nozzle, but the uniform mixing between the fuel and the air streams in the vicinity of the axial part is not effectively carried, so an effective low-temperature combustion cannot be attained and a vicinity of the axial part is not at a high temperature. Thus, considerable amounts of NOx are produced.

The aim underlying the present invention essentially resides in providing a gas turbine combustor which can readily attain a reduction of NOx and simultaneously, a reduction of CO when, not only a liquid fuel, but also a gaseous fuel is used.

In accordance with advantageous features of the present invention a gas turbine combustor is provided which is effectively supplied with air to a high temperature portion of the combustor in a vicinity of an axial part in a head combustion chamber and reduced to a lower temperature so as to obtain a sharp reduction in the production of NOx.

According to the present invention a group of air feeding ports are respectively disposed on a upper stream side, a lower stream side and intermediate of a side wall of a head combustion chamber.

Advantageously, in accordance with another feature of the present invention a group of air feeding ports for supplying turbulent air are provided in the inner and outer peripheries of a group of fuel nozzle of a combustor, with the inner and outer air feeding ports being constructed so as to bring the turbulent air into an identical swirling direction.

By virtue of the features of the present invention, several advantages are realized. More particularly, the flame temperature may be maintained at a suitable temperature in substantially the whole region within the inner pipe including the enlarged portion so as to achieve both a reduction in the production of NOx and a reduction in the production of CO. Further, the swirling air flow is again intensified so as to lengthen and stabilize the flames.

A further advantage of the present invention resides in the fact that, due to the use of the gaseous fuel, even when a quantity of air to be fed is made smaller than the quantity of air fed with the use of the liquid fuel, a radial inflowing air from the group of intermediate air feeding ports on the side wall of the head combustion chamber properly cools the central flames at the high temperature and hence, the production of NOx can be suppressed. The air flowing into the head combustion chamber spreads the flames sufficiently at least three times into the head combustion chamber, and further spreads them sufficiently onto the succeeding inner walls of the enlarged portion and the rear combustion chamber. Accordingly, a flame recess in a vicinity of the enlarged portion, as occurs in previously proposed combustion, is not formed. Thus, the production of CO is suppressed.

Another advantage of the present invention resides in the fact that, since the group of air swirling and feeding ports are provided on the fuel nozzle side of the side wall of the head combustion chamber, the air flow through the ports induce a suction therefore a strong recirculation flow is induced in a vicinity of the longitudinal axis of the combustor. Furthermore, since the intermediate air feeding ports are provided between the two groups of air swirling and feeding ports, the air supplied into the strong recirculation flow and the central portion of the combustor is cooled by the air. In this manner, since the recirculating flow is intense, the surrounding high-temperature gas flow is involved in the recirculating flow, and simultaneously, the staying time of the combustion gas longer, whereby the flame temperature can be made uniform, so as to enable a sufficient reduction in the production of both CO and NOx. In a position or area where the swirling intensity begins to decay due to the air inflow through the group of the intermediate air feeding ports, the swirl is intensified again by the swirling air through the group of air swirling and feeding ports, so that the flame spreading effect described hereinabove can more realiably be achieved.

Yet another advantage of the present invention resides in the fact that a distance between the intermediate air feeding ports and the fuel nozzle side end of the head combustion chamber is substantially equal to the inside diameter of the head combustion chamber. The inventors have experimentally confirmed that this position of the intermediate air feeding ports does not disturb the swirl of the flames and that it is the most suitable for forming the recirculating flow and for cooling the central flames. The group of central air feeding ports supply air to the recirculating flow which is induced by the group of air swirling and feeding ports situated upstream. If the position of the group of central air feeding ports is too close to these groups of air swirling and feeding ports, the inflowing air from the group of central air feeding ports must penetrate the intense swirling air flow, to ultimately suppress the swirling air flow. The air through the central air feeding ports does not cause the suppression of the swirling air flow, and can ensure an air penetration distance up to the longitudinal axis of the combustor in the radial direction.

A still further advantage of the present invention resides in the fact that, since a group of air swirling and feeding ports are provided at the rearmost part of the head combustion chamber, a low-temperature region which arises downstream of the head combustion chamber is canceled by the high-temperature eddy flow which is intensified by the swirling air flowing in a tangential from the group of air swirling and feeding ports. Moreover, this swirling air flow expands along the enlarged portion of the inner pipe without fail. Eventually, the low-temperature region appears neither in the head combustion chamber nor in the vicinity of the enlarged portion.

Another advantage of the present invention resides in the fact that, by virtue of the provision of another group of air feeding ports disposed immediately behind the enlarged portion and on the side wall of the rear combustion chamber, the inventors have experimentally confirmed that this position of the feeding ports is the most suitable for not only forming the recirculating flows at the enlarged portion and in the rear combustion chamber but also for stabilizing the flames.

Since, in accordance with the present invention, a group of air swirling and feeding ports are provided in the inner and outer peripheries of a group of fuel nozzles, the air through the ports cools the portion in the vicinity of longitudinal axis of the combustor where NOx is generated. As a result, the NOx concentration can be reduced and the combustion flames can be stabilized.

Accordingly, it is an object of the present invention to provide a gas turbine combustor which avoids by simple means shortcomings and disadvantages encountered in the prior art.

Another object of the present invention resides in providing a gas turbine combustor which substantially reduces the production of NOx and CO with not only a liquid fuel but also with a gaseous fuel.

Yet another object of the present invention resides in providing a gas turbine combustor which functions reliably under all operating conditions.

A still further object of the present invention resides in providing a gas turbine combustor which optimizes a length of a combustion flame and stabilizes the combustion flame during a combustion process.

These and other objects, features, and advantages of the present invention will become more apparent from the following description when taken in connection with the accompany drawings, which show, for the purposes of illustration only, several embodiments in accordance with the present invention, and wherein:

FIG. 1 is a partially schematic cross-sectional view of a gas turbine combustor in accordance with the present invention;

FIG. 2 is a cross-sectional view taken along the line II—II in FIG. 1;

FIG. 3 is a cross-sectional view taken along the lines III—III in FIG. 1;

FIG. 4 is a cross-sectional view depicting the gas flow in the combustor of FIG. 1;

Figure 5:
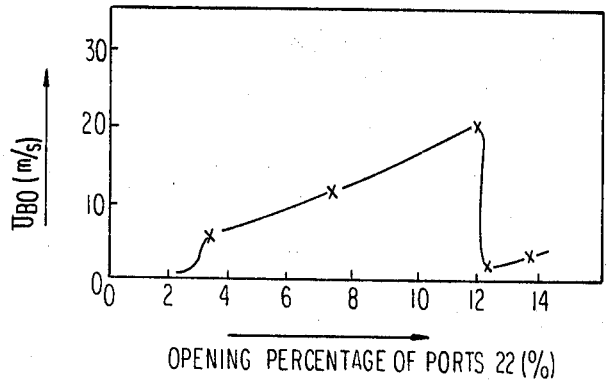
FIG. 5 is a diagram of a relationship between an opening percentage of a group of air swirling and feeding ports and a flame flow for the combustor of FIG. 1.

Referring now to the drawings wherein like reference numerals are used throughout the various views to designate like parts and, more particularly, to FIG. 1, according to this figure, a combustor generally designated by the reference numeral 2 is located between a compressor 4 and a turbine 6. The combustor 2 is principally constructed of an outer cylindrical member or pipe 8 and an inner cylindrical member or pipe 10. A fuel nozzle 12 is fixedly mounted to a cover 14 of the outer pipe 8. The fuel nozzle 12 extends through the cover 14 and opens into one end of the inner pipe 10. The fuel nozzle 12 supplies, for example, gasified LNG to the combustor 2. The inner pipe 10 is formed of a head or main combustion chamber 16 located on the side of the fuel nozzle 12, and a rear or secondary combustion chamber 18 located on the side of the turbine 6. A diameter of the rear combustion chamber 18 is larger than a diameter of the head combustion chamber 16. An enlarged portion 20 forms a transition area between the combustion chambers 16 and 18 with the enlarged portion 20 having a changing diameter. A group of air swirling and feeding ports 22 are disposed in an area of the head combustion chamber 16 into which the fuel nozzle 12 opens. These ports 22 may also be termed "swirler" or "turbulence imparting means." A further group of air swirling and feeding ports 24 are circumferentially disposed in a side wall of an end part of the head combustion chamber 16. As shown most clearly in FIG. 2, each of the air swirling and feeding ports 24 opens tangentially so that the supplied air swirls in the head combustion chamber 16.

A group of air feeding ports 28 are similarly circumferentially disposed in a sidewall 26 of the head combustion chamber 16 on a downstream side of the air swirling and feeding ports 24 that is, on a side of the rear combustion chamber 18. As shown in FIG. 3, the group of air swirling and feeding ports 28 are disposed so that the respective ports open in radial directions. A distance between the group of air swirling and feeding ports 24 and the group of air feeding ports 28 is substantially equal to an inside diameter of the head combustion chamber 16. A further group of air swirling and feeding ports 30, as shown in FIG. 1, are similarly circumferentially disposed as the air swirling and feeding ports 24. The air swirling and feeding ports 30 are disposed in the side wall 26 of the head combustion chamber 16 on the downstream side of the group of air feeding ports 28.

As shown in FIG. 1, the group of air swirling and feeding ports 30 are located at an end portion of the head combustion chamber 16 on a side of the enlarged portion 20 of the inner pipe 10 facing the fuel nozzle 12. A group of air feeding ports 34 are circumferentially disposed in the sidewall 32 of the rear combustion chamber 18 in a vicinity of on enlarged portion 20 on a side thereof facing the turbine 6. Another group of air feeding ports 36 are disposed in the side wall 32 downstream of the air feeding ports 34. The opening directions of the air feeding ports 34 and 36 coincide with the radial opening directions of the ports 28. The supplying of air through the swirling and feeding ports 22 results in a swirling air flow 38 indicated in FIG. 1. The swirling air flow 38 is the air flow affected by the air swirling and feeding.

The turbine combustor 2 operates in the following manner:

Fuel 40 which, as noted above, may, for example, be gasified LNG, is supplied from the fuel nozzle 12 into the head combustion chamber 16 with air 42, compressed by the compressor 4 and supplied between the outer pipe 8 and the inner pipe 10, flowing into the inner pipe 10 through the various groups of air swirling and feeding ports 28, 34 and 36. A portion of the air 42 flows from the group of air swirling and feeding ports 22 into the head combustion chamber 16 and forms the swirling air flow 38 in an axial direction of the combustor 2.

As shown in FIG. 4, upon ignition by conventional means (not shown), the fuel 40 turns into combustion flames 44 which extend in the axial direction of the combustor 2. The combustion flames 44 are stretched by the swirling air flow 46 and are more intensely swirled by the tangential air inflow from the group of air swirling and feeding ports 24 resulting in the combustion flames 44 being spread sufficiently within the head combustion chamber 16. By virtue of the radial disposition of the group of air feeding ports 28 (FIG. 3) air flows from air feeding ports 28 into the intense swirling air flow 46.

A recirculating flow 48 is induced in a vicinity of the longitudinal axis of the combustor 2 due to the suction of the swirling air flow 46 with the recirculating flow 48 assisting in holding or stabilizing the shape of the flames 44. A portion of the air flowing from the group of air feeding ports 28 is used for the recirculating flow 48. Further, the inflowing air from the air feeding ports 28 cools high-temperature flames formed in a central part of the head combustion chamber 16 and suppresses the production of NOx.

Subsequently, an intense swirl is again exerted by an air flow from the group of air swirling and feeding ports 30 with the intensified swirling air flow 46 gradually expanding along the wall surface of the enlarged portion 20, and sufficiently spreading within the rear combustion chamber 18. Since the length of time of combustion gas remains in the combustor 2 is lengthened under the swirling state and since the swirling action ensures that no low-temperature region develops, the production of CO is suppressed and, if CO is produced, the CO reburns during the stay of the combustion gas in the combustor 2.

As shown in FIG. 4, the direction of the air inflow from the group of air swirling and feeding ports 30 is substantially tangential along the inner wall surface. Therefore, the velocity component of the inflowing air in the axial direction becomes small thereby lengthening the staying time of the combustion gas. Even in the process in which the swirling air flow 46 and the flames 44 spread along the enlarged portion 20 as shown in FIG. 4, a recirculating flow 50 develops with a portion of the inflowing air from the group of air feeding ports 34 being used for the recirculating flow 50. This inflowing air from the air feeding ports 34 cools high-temperature flames which continue to be formed in the central part of the combustor 2 behind the enlarged portion 20 so that the production of NOx is suppressed. Further, since the high-temperature flames are involved by the recirculating flow 50, any low-temperature region due to supercooling is not generated thereby further ensuring a suppression of the production of CO. In this manner, the flames 44 are stably held at suitable temperatures. Eventually, a temperature of the combustion gas 52 is lowered to an optimum turbine-inflow temperature by the air inflow from the group of air feeding ports 36 and the combustion gas 52 goes out of the combustor 2.

In an embodiment of the combustor 2, as noted above, the groups of air swirling and feeding ports or air feeding ports are disposed in the six places. The total open area of all the groups of air feeding ports as well as the percentages of the open areas of the respective groups of air feeding ports, hereinafter simply termed "opening percentages" are determined in the following manner.

The group of air swirling and feeding ports 22 are set at an opening percentage of 10%, the group of air swirling and feeding ports 24 at 18%, the group of air feeding ports 28 at 16%, the group of air swirling and feeding ports 30 at 9%, the group of air feeding ports 34 at 20%, and the group of air feeding ports 36 at 27%.

The effects of the above-noted opening percentages of the respective groups of air feeding ports in the above-described embodiment will now be explained together with the ranges of the optimum opening percentages of the respective groups of air feeding ports. Since the combustion state within the combustor 2 is mostly determined by the combustion state within the head combustion chamber 16, the reduction of NOx and the reduction of CO can be satisfactorily accomplished by the opening percentages of the groups of air swirling and feeding ports 22, 24 and 30 and the group of air feeding ports 28.

With regard to the opening percentage of the group of air swirling and feeding ports 22, since the swirling air flow 46 which begins at the group of air swirling and feeding ports 22 has direct influence on the mixing of the fuel, and further affects the intensity of the recirculating flow 48, the stability of the flames is mostly determined by the opening percentage of the group of air swirling and feeding ports 22.

FIG. 5 diagramatically illustrates the results obtained by observing the limitation at which the combustion flames vanished, with the opening percentage of the group of air swirling and feeding ports 22 varied. In order to maintain a constant pressure loss in the whole combustor, the opening percentage of the group of air feeding ports 36 was varied with that of the group of air swirling and feeding ports 22, but all the opening percentages of the other groups of air feeding ports were selected to the optimum ranges. In FIG. 5, the ordinate represents a flame flow velocity ($U_{BO}$ (m/s)) in an axial flow direction within the head combustion chamber 16 at a vanishing of the combustion flame, with the abscissa representing the opening percentage of the air swirling and feeding ports 22. As evident from FIG. 5, as the value of the flame flow velocity becomes greater, the opening percentage of the air swirling and feeding ports 22 may be greater so that a larger quantity of air can be supplied from the group of air swirling and feeding ports 22 in order to make a stable combustion possible. A region in which $U_{BO}$ is greater than the characteristic curve in FIG. 5 is an incombustible region in which the axial flow velocity becomes too high and a blow-off phenomenon of the combustion flames takes place thereby making it impossible to sustain the combustion process.

When the opening percentage of the group of air swirling and feeding ports 22 is below 4%, the swirling air flow 46 which exerts a great influence on the sustaining of the flames weakens, followed by the diminution of the recirculating flow 48, so that the sustention of the combustion flames becomes difficult. On the other hand, when the opening percentage of the group of air swirling and feeding ports 22 is above 12%, the quantity of air from the group of air swirling and feeding ports 22 is too large and the fuel concentration becomes thin, so that the sustaining of the combustion flames is also difficult. Thus, with a gaseous fuel, an optimum opening percentage of the group of air swirling and feeding ports 22 for stabilizing the combustion flames 4 lies in the range of 4–12%. Since the opening percentage of the group of air swirling ports 22 of the above-described embodiment of the present invention of 10% falls within the range of the present invention of a satisfactory effect is demonstrated for the stabilization of the combustion flames.

Figure 6:
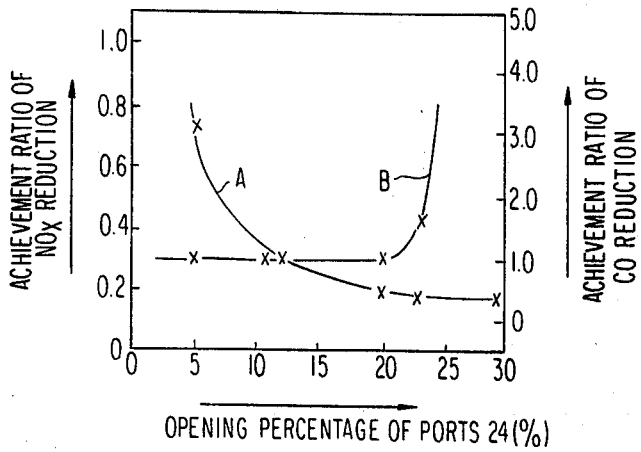
FIG. 6 is a diagram of the relationships between an opening percentage of a group of air swirling and feeding ports and a ratio of a reduction of NOx and CO, respectively for the combustor of FIG. 1.

With regard to the opening percentage of the group of air swirling and feeding ports 24, the air from the group of air swirling and feeding ports 24 flows in along the inner wall surface of the head combustion chamber 16 from outside the group of air swirling and feeding ports 22 mixes with the gaseous fuel well and forms the main flames so it is also greatly influential on the reduction of NOx and the reduction of CO. FIG. 6 diagramatically illustrates the results obtained by observing the reduction effects of NOx and CO upon a varying of the opening percentage of the group of air swirling and feeding ports 24. In order to maintain a pressure loss over the whole combustor, the opening percentage of the group of air feeding ports 36 was varied with that of the group of air swirling and feeding ports 24, but all the opening percentages of the other groups of air feeding ports were selected to the optimum ranges.

As shown in FIG. 6 the ordinates represent the achievement ratio of the reduction of NOx and that of the reduction of CO with the abscissa representing the opening percentage of the air swirling and feeding ports 24. A curve A represents an achievement ratio of NOx reduction and a curve B shows an achievement ratio of CO reduction. Both curves represent the ratios of the effects of the combustor 2 of the present invention relative to the respective effects of a combustor, using a gaseous fuel, which is presently in operation in a gas turbine plant. The combustor presently in operation which was used for comparative purposes includes an inner pipe having a uniform diameter and is not constructed of the two combustion chambers as in the embodiment of the invention described hereinabove. For the sake of comparison with the combustor presently in operation, the inner pipe and the rear combustion chamber 18 of the above-described embodiment were made equal in diameter. Further, in the combustor presently in operation, ports corresponding to the group of air swirling and feeding ports 22 and the groups of air feeding ports 34 and 36 in the above-described embodiment are disposed in the same positions, and a group of air feeding ports for supplying secondary air as shown in FIG. 3 are disposed at substantially the same distance in the axial direction as that of the group of air feeding ports 28 in the present invention, whereas ports corresponding to the groups of air swirling and feeding ports 24 and 30 in the present embodiment are not disposed in the inner pipe.

As shown in FIG. 6, the CO concentration becomes higher than that of the combustor presently in operation when the opening percentage exceeds 20%. The main cause for the increase in CO concentration is that the supercooling effect, due to the swirling air flow, increases suddenly. This tendency is conspicuous especially under low turbine load conditions, for example, in cases where the flow rate of supply for combustion has decreased with the inflow of air to the combustor is kept constant. In, for example, Japan, it is required to reduce the present NOx concentration of the combustion gas to about 70%, that is, the achievement ratio of the reduction of NOx is about 0.3. To this end, the opening percentage of the group of air swirling and feeding ports 24 needs to be set at 12% or more. As the quantity of air supply from the group of air swirling and feeding ports 24 becomes larger, the effect of reducing NOx is greater. Below 12%, the quantity of air is small, and hence, the air has little effect on the thin low-temperature combustion, so that the effect of reducing Nox is low. Therefore, the optimum opening percentage of the group of air swirling and feeding ports 24 for the reduction of NOx and the reduction of CO is in the range of between 12–20%. Since the opening percentage of the air swirling and feeding ports 24 of the above-described embodiment of the present invention of 18% falls within this range the effects are satisfctorily demonstrated.

Figure 7:
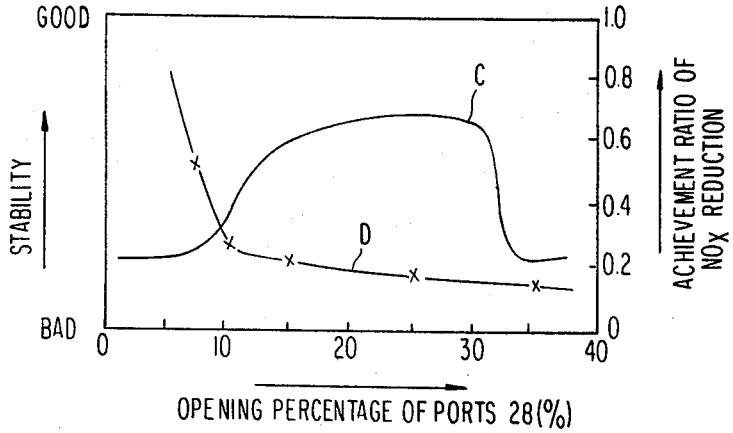
FIG. 7 is a diagram of the relationships between an opening percentage of a group of air feeding ports, and a stability of combustion flames and a ratio of the reduction of NOx, respectively, for the combustor of FIG. 1.

With regard to the opening percentage of the group of air feeding ports 28, as noted hereinabove, the group of air feeding ports 28 accomplished the stabilization of the combustion flames and contribute greatly to the reduction of NOx. FIG. 7 diagramatically illustrates results obtained by observing the stability of the combustion flames and the effect of reducing NOx, with a varying of the opening percentage of the group of air feeding ports 28. In order to maintain a constant pressure loss over the whole combustor, the opening ratio of the group of air feeding ports 36 was varied with that of the group of air feeding ports 28, but all the opening percentages of the other groups of air feeding ports were selected to the optimum ranges. In FIG. 7 the ordinates represent combustion flame stability and achievement of ratio of NOx reduction and the abscissa represents the opening percentage of the air feeding ports 28, and curve C represents a stability of the combustion flames, and a curve D represents a change of Nox concentration. The effect of reducing NOx is indicated in terms of an achievement ratio of the reduction of NOx similar to that concerning the group of air swirling and feeding ports 24.

When the opening percentage of the air feeding ports 28 exceeds 32%, the inflow of air through the air feed ports 28 is too intense so that the combustion flames are split into pre-stage combustion flames within the head combustion chamber 16 and post-stage combustion flames within the rear combustion chamber 18 substantially in the area of the group of air feeding ports 28. These split combustion flames interfere with each other, and both the combustion flames fluctuate in an axial direction to give rise to a so-called vibrating combustion phenomenon. On the other hand, when the opening percentage of the air feeding ports 28 is below 10%, the air flow from the group of air feeding ports 28 is too weak so that the penetration of air leading to the central part of the head combustion chamber 16 does not occur, and the action of cooling the center of the combustion flames becomes almost null; therefore, it is impossible to attain the reduction of NOx. Moreover, since the quantity of air supply to the recirculating flow 48 decreases, the fuel concentration becomes high, resulting in an unstable combustion process. Therefore, the optimum opening percentage of the group of air feeding ports 28 for reducing Nox and for stabilizing the combustion flames lies in the range of 10–32%. Since the opening percentage of the air feeding ports 28 of the above-described embodiment of the present invention of 16% falls within this range, the effects are satisfactorily demonstrated.

Figure 8:
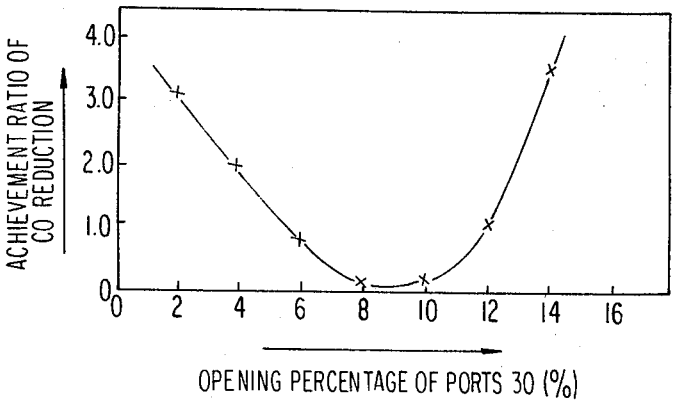
FIG. 8 is a diagram of the relationship between an opening percentage of a group of air swirling and feeding ports and a ratio of the reduction of CO for the combustor of FIG. 1.

With regard to the opening percentage of the group of air swirling and feeding ports 30, as noted above, the group of air swirling and feeding ports 30 strengthen the swirling air flow 46 again so as to thereby avoid an appearance of the low-temperature region and to suppress the production of CO in addition to functioning to reburn CO in the stage even when it is reduced. FIG. 8 diagramatically illustrates the effect of reducing CO in terms of the achievement ratio similar to that described above in connection with the group of air swirling and feeding ports 24, with the opening part of the group of air swirling and feeding port 30 varied. In order to maintain a constant pressure loss over the whole combustor, the opening percentage of the group of air feeding ports 36 was varied with that of the group of air swirling and feeding ports 30, but all the opening percentages of the other groups of air feeding ports are selected to the optimum ranges.

At opening percentages below 8%, the swirl weakens, so that the effect decreases; however above 11%, the swirl is too intense, and it does not sufficiently spread to the inner wall surface of the rear combustion chamber 18. Accordingly, as apparent from FIG. 8, the optimum opening percentage of the group of air swirling and feeding ports 30 is in the range of between about 8–11%. Since the opening percentage of the above-described embodiment of the present invention of 9% falls within this range, the effect is satisfactorily demonstrated.

While at present there are no detailed regulations regarding the CO concentration, the C concentration ought to be suppressed to be, at least, lower than the CO concentration in the combustion gas of the aforementioned combustor presently in operation. Thus, it is desirable that the opening percentage of the group of air swirling and feeding ports 30 be in a range of between 6–12%.

The table below lists the effects achieved by the entire combustor with the opening percentages of the respectives groups of air feeding ports described above. In the comparisons, the quantity of inflowing air to the head combustion chamber 16 was principally varied, and the quantity of inflowing air to the rear combustion chamber 18 was also varied in order to suppress the pressure loss of the whole combustor between to 3–4%. However, the comparisons were simplified by maintaining the opening percentage of the group of air feeding ports 34 constant. In the table the symbol ◎ represents the best results for reduction in the concentration of NOx and C and/or flame stability obtained for the listed opening percentages of the groups of air and feeding ports, with the symbol ○ representing better results than previously proposed combustor, the symbol Δ representing results which are approximately the same as previously proposed combustors, and the symbol X representing poor results with respect to combustion flame stability.

| | Opening percentage of groups of air feeding ports (%) | | | | | | Reduction of NOx | Reduction of CO | Stability |
|---|---|---|---|---|---|---|---|---|---|
| | ports | ports | ports | ports | ports | ports | | | |
| 1 | 22 | 24 | 28 | 30 | 34 | 36 | ○ | | |
| 2 | <4% | 14 | 20 | 9 | 20 | >33 | ○ | Δ | X |
| 3 | >12 | 14 | 20 | 9 | 20 | <25 | ◎ | Δ | X |
| 4 | 10 | <12 | 20 | 9 | 20 | >27 | Δ | ◎ | ○ |
| 5 | 10 | >18 | 20 | 9 | 20 | <21 | ◎ | ◎ | ○ |
| 6 | 10 | 18 | <4 | 9 | 20 | >39 | ◎ | Δ | X |
| 7 | 10 | 18 | >32 | 9 | 20 | <11 | ◎ | Δ | X |
| 8 | 10 | 18 | 16 | 9 | 20 | 27 | ◎ | ◎ | ◎ |
| 9 | 10 | 18 | 16 | >6 | 20 | 30 | ◎ | Δ | ○ |
| 10 | 10 | 12 | 16 | >12 | 20 | 30 | ○ | ○ | Δ |

Figure 9:
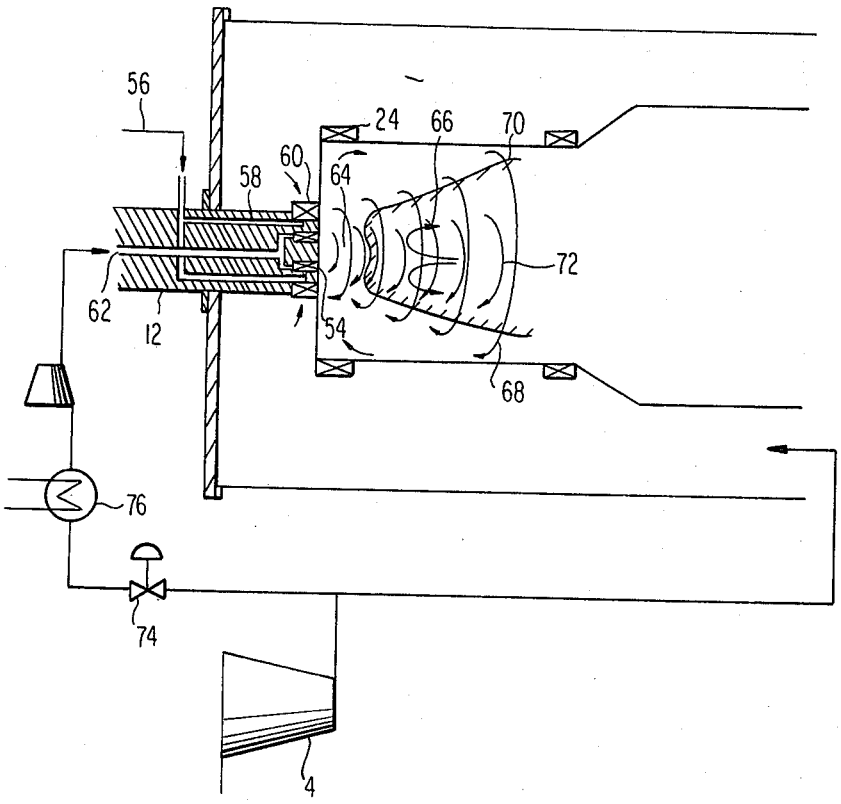
FIG. 9 is a cross-sectional view of another embodiment of a gas turbine combustor in accordance with the present invention.

FIG. 9 shows another embodiment of the present invention and, according to this figure a group of air swirling and feeding ports 54 which supply turbulent air into the head combustion chamber 16 are disposed in a vicinity of a central part of the side end of the head combustion chamber 16. A fuel nozzle 12 is provided in an outer periphery of the group of air swirling and feeding ports 54. Fuel 56 is injected into the head combustion chamber 16 through a fuel feeding passage 58 of the fuel nozzle 12. A group of air swirling and feeding ports 60 are provided in the outer periphery of the fuel nozzle 12. The air from the group of air swirling and feeding ports 60 is mixed with fuel and injected into the head combustion chamber 16. The group of air swirling and feeding ports 60 introduce cooling air, obtained by partial extraction from a compressor 4, through an air passage 62, so as to cool a vicinity of the axial port 64 of the head combustion chamber 16. Air flow from the ports 54 and air from the ports 60 swirls in the same direction. A recirculating flow 66 is generated in a vicinity of the axial port 64 by swirling flows 68 from the air swirling and feeding ports 60 and 24. Since the circulating flow 66 involves a combustion gas at a high-temperature, the temperature of the vicinity of the axial port 64 becomes high, and particularly, a part of the swirling flow 68 from the ports 60 becomes a high temperature part 70. However, the swirling flow 72 from the air swirling and feeding ports 54 are supplied between the recirculating flow 66 and the mixed swirling flow 68 of fuel and air, whereby the recirculating flow 66 can be further promoted and besides the high temperature part 70 can be effectively cooled, so that the generation of NOx can be suppressed.

To supply the swirling flows 72 in the same direction as those of the ports 60 it is necessary to promote the recirculating flow 66 and render a good stability to the combustion process. If air is supplied slightly in the axial direction without being made to assume a swirling flow, it will form a flow against the direction of the recirculating flow 66 because of the ports 60 and the swirling flow 18. Therefore, the recirculating flow will disappear, making it impossible to hold stable combustion flames. For this reason, preferably, the cooling air from the ports 54 swirls, and desirably it has the same swirling angle as that of the ports 60.

Figure 10:
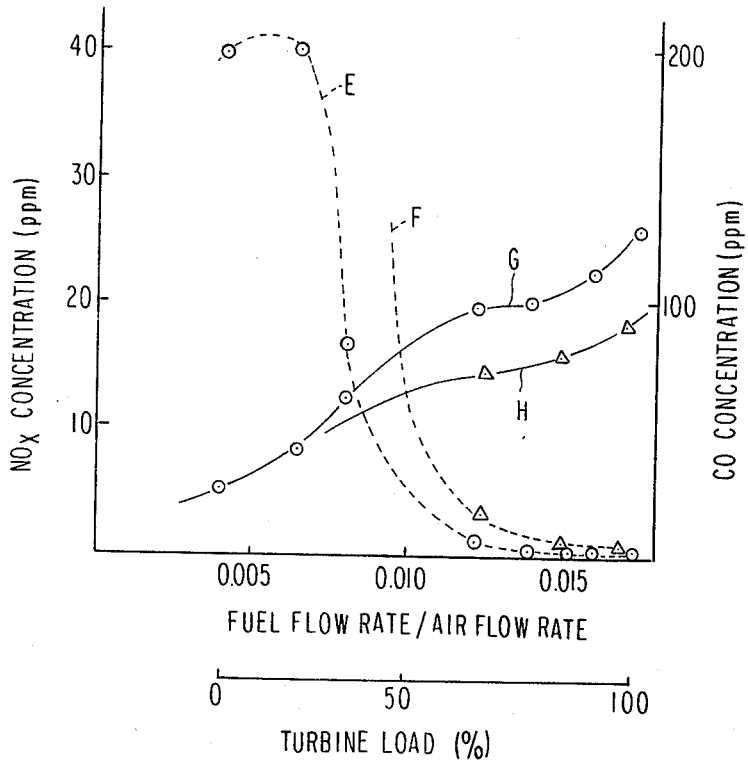
FIG. 10 is a diagram illustrating concentration characteristics of NOx and CO in the exhaust gases of a gas turbine having a combustor constructed in accordance with the present invention.

FIG. 10 provides a diagrammatic illustration of results obtained by testing NOx-reducing effects in the cases where the cooling air is supplied from the ports 54 and in cases where there is no supply of cooling air from the ports 54 are not illustrated in FIG. 10. In the FIG. 10, the ordinates represent the concentration of NOX in ppm and the concentration of CO in ppm while the abscissa represents a ratio of the flow rate of fuel to the flow rate of air for the turbine load. The tests were conducted under the conditions that the temperature of the air for combustion was 180° C. and the pressure within the combustor was 4 atm. The curves E, F in phantom lines indicate variations of the NOx concentrations and the curves G, and H, in solid line, indicate variations of the CO concentrations. For comparative purposes, the symbols ◎ represent conditions previously proposed combustors with a swirling air flow, and the symbols Δ represent conditions obtained with the combustor of the present invention having a swirling air flow 72.

As apparent from FIG. 10, when the cooling air is supplied from the ports 54, the NOx producing portion of the head combustion chamber 16, is, as noted hereinabove, effectively cooled by the swirling air flow 72, and hence, the concentration of NOx is lowered. However, the CO concentration tends to increase with the lowering of the turbine load for the reasons described more fully hereinbelow.

The lowering of the turbine load decreases the fuel and at this time, the quantity of air is substantially constant regardless of the load. Consequently, as the load lowers, the quantity of air per unit fuel increases, so that the air becomes excessive and there is an increase in a generation of CO due to supercooling. Further, to supply the swirling air for cooling in order to reduce NOx promotes the supercooling still more and raises the CO concentration. Therefore, an air flow rate regulating valve 74 is provided for reducing the flow rate of cooling air with a decrease of the turbine load so as to enable a low concentration of NOx as well as a suppression of the concentration of generation of CO over the whole range of turbine loads.

As noted above, the reduction of NOx can be sharply achieved by lowering the temperature, therefore it is effective to increase the flow rate of cooling air or to further lower the temperature of the cooling air. As means for cooling the air extracted from the compressor 4 to lower the temperature, an heat exchanger 76 is provided. In this connection, a lowering of the temperature of the cooling air to, for example, approximately 100° C. results in a lowering of the NOx concentration to about ⅓rd.

As can readily be appreciated, more effective advantages may be obtained by combining the features of the embodiment of FIG. 1 with the features of the embodiment of FIG. 9, that is, by providing a group of ports in the vicinity of a central portion of an end part of the head combustion chamber 16 and in an inner periphery of the fuel nozzle 12 in the embodiment of FIG. 1.

While we have shown and described several embodiments in accordance with the present invention, it is understood that the same is not limited thereto but is susceptible to numerous changes and modifications as known to one having skill in the art and we therefore do not wish to be limited to the details shown and described herein, but intend to cover all such modifications as are encompassed by the scope of the appended claims.

We claim:

1. A gas turbine combustor comprising:

a combustion inner-pipe means for defining a head combustion chamber means and a rear combustion chamber means having a diameter larger than a diameter of the head combustion chamber means, a combustor outer-pipe means for covering said combustor inner-pipe means, fuel nozzle means disposed at an end part of the head combustion chamber means for supplying fuel to said combustion inner-pipe means, a first group of port means disposed at the end part of the head combustion chamber means around said fuel nozzle means for feeding air into said combustor inner-pipe means, said first group of port means being disposed such that air entering through said port means has a component of velocity directed axially of the combustor inner pipe means, a second group of port means disposed in a side wall of said head combustion chamber means at a position near said fuel nozzle means for feeding air into said combustor inner-pipe means, a third group of port means disposed in the side wall of the head combustion chamber means at a position near to the rear combustion chamber means for feeding air into said combustor inner-pipe means, and a fourth group of port means disposed in the side wall of the head combustion chamber means at a position intermediate of said second and third groups of port means for feeding air into said combustion inner-pipe means, the second, third and fourth groups of port means all being so arranged that air entering through the port means has a component of velocity directed radially into said combustor inner pipe means, said first, second, and third groups of port means are arranged so that air entering through them additionally has a component of velocity directed circumferentially around said combustor inner-pipe means to impart a swirl to fluid within said combustor inner-pipe means and said fourth group of port means are arranged so that air entering through them has no substantial component of velocity directed circumferentially around said combustor inner-pipe means.

2. A gas turbine combustor comprising:

a combustor inner-pipe means for defining a head combustion chamber means and a rear combustion chamber means having a diameter larger than a diameter of the head combustion chamber means, a combustion outer-pipe means for covering said combustor inner pipe means, fuel nozzle means disposed at an end part of the head combustion chamber means for supplying fuel to said combustion inner-pipe means, a first group of port means disposed around said fuel nozzle means for feeding air into said combustor inner-pipe means, said first group of port means are arranged so as to swirl and supply air in an axial direction of said combustion inner-pipe means, a second group of port means disposed in a side wall of said head combustion chamber means at a position near said fuel nozzle means for feeding air into said combustor inner-pipe means, said second group of port means are arranged so as to swirl and supply air in a radial direction of said combustion inner-pipe means, a third group of port means disposed in the side wall of the head combustion chamber means at a position near to the rear combustion chamber means for feeding air into said combustor inner-pipe means, said third group of port means are arranged so as to swirl and supply air in radial direction of said combustion inner pipe means, and a fourth group of port means disposed in the side wall of the head combustion chamber means at a position intermediate of said second and third groups of port means for feeding air into said combustor inner-pipe means, said fourth group of port means are arranged so as to supply air in a radial direction of said combustor inner pipe means.

3. A gas turbine combustor according to claim 2, wherein said second group of port means open in a direction substantially tangentially of an inner peripheral surface of the head combustion chamber means.

4. A gas turbine combustor according to claim 2, wherein said third group of port means open in a direction substantially tangentially of an inner peripheral surface of the head combustion chamber means.

5. A gas turbine combustor according to claim 2, wherein a distance between said second and fourth groups of port means is substantially equal to an inside diameter of the head combustion chamber means.

6. A gas turbine combustor according to claim 2, further comprising a fifth group of port means disposed in a side wall of the rear combustion chamber means at a position near the head combustion chamber means for feeding air into the rear combustion chamber means, and the sixth group of port means disposed in the side wall of a rear combustion chamber on a downstream side of the fifth group of port means for feeding air into the rear combustion chamber means.

7. A gas turbine combustor according to claim 2, wherein a total open area of said first group of port means is in a range of between 4–12% of a total open area of all the groups of port means.

8. The gas turbine combustor as defined in claim 2, wherein a total open area of said second group of port means is in the range of 12–20% of the total open area of all the groups of ports.

9. A gas turbine combustor according to claim 2, wherein a total open area of said third group of port means is in a range of between 6–12% of a total open area of all the groups of port means.

10. A gas turbine combustor according to claim 2, wherein a total open area of said fourth group of port means is in a range of between 10–32% of a total open area of all the groups of port means.

11. A gas turbine combustor according to claim 2, wherein each total open area of said first group of port means, said second group of port means, said third group of port means and said fourth group of port means is respectively in the ranges of 4–12%, 12–20%, 6–12%, and 10–32% of a total open area of all the groups of port means.

12. A gas turbine combustor according to claim 1, wherein said second group of port means open in a direction substantially tangentially of an inner peripheral surface of the head combustion chamber means.

13. A gas turbine combustor according to claim 12, wherein said third group of port means open in a direction substantially tangentially of an inner peripheral surface of the head combustion chamber means.

14. A gas turbine combustor according to claim 1, wherein a distance between said second and fourth groups of port means is substantially equal to an inside diameter of the head combustion chamber means.

15. A gas turbine combustor according to claim 1, wherein said gas turbine combustor further comprises:

a fifth group of port means disposed in a side wall of the rear combustion chamber means at a position near to the head combustion chamber means for feeding air into the rear combustion chamber means, and a sixth group of port means disposed in the side wall of the rear combustion chamber means at a position on the downstream side of the fifth group of port means for feeding air into the rear combustion chamber means.

16. A gas turbine combustor according to claim 15, wherein a total open area of said first group of port means is in the range of between 4–12% of a total open area of all the groups of port means.

17. A gas turbine combustor according to claim 15, wherein a total open area of said second group of port means is in the range of between 12–20% of a total open area of all the groups of port means.

18. A gas turbine according to claim 15, wherein a total open area of said third group of port means is in the range of between 6–12% of a total open area of all the groups of port means.

19. A gas turbine combustor according to claim 15, wherein a total open area of said fourth group of port means is in the range of between 10–32% of a total open area of all the groups of port means.

20. A gas turbine combustor according to claim 15, wherein each total open area of said first group of port means, said second group of port means, said third group of port means and said fourth group of port means is respectively in the range of 4–12%, 12–20%, 6–12% and 10–32% of a total open area of all the groups of port means.

21. A gas turbine combustor according to claim 15, wherein said fifth group of port means are so arranged that air entering through them has a component of velocity directed radially into said combustion inner pipe means but no substantial component of velocity directed circumferentially around said combustor inner-pipe means.

* * * * *